United States Patent [19]

Gatz

[11] Patent Number: 4,907,714

[45] Date of Patent: Mar. 13, 1990

[54] RESILIENT PAINT CAN ACCESSORY

[76] Inventor: Michael F. Gatz, 517 94th Ave. North, Naples, Fla. 33963

[21] Appl. No.: 316,230

[22] Filed: Feb. 27, 1989

Related U.S. Application Data

[63] Continuation-in-part of Ser. No. 52,268, May 21, 1987, abandoned.

[51] Int. Cl.[4] ..... B65D 25/48

[52] U.S. Cl. ..... 220/90; 220/307; 222/570

[58] Field of Search ..... 220/90, 307; 222/570

[56] References Cited

U.S. PATENT DOCUMENTS

| | | | |
|---|---|---|---|
| 2,721,595 | 10/1955 | Nichols | 220/307 |
| 3,221,955 | 12/1965 | Banaszak | 220/90 |
| 3,356,266 | 12/1967 | Pinter | 220/90 |
| 3,463,366 | 8/1964 | Spencer | 222/570 |
| 3,998,352 | 12/1976 | Hopkins | 220/90 |
| 4,203,537 | 5/1980 | McAlister | 220/90 |
| 4,225,064 | 9/1980 | Westcott | 222/570 |
| 4,240,568 | 12/1980 | Pool | 220/90 |
| 4,369,890 | 1/1983 | Bennett | 220/90 |
| 4,401,225 | 8/1983 | Schwaikert | 220/307 |

*Primary Examiner*—George E. Lowrance
*Attorney, Agent, or Firm*—A. W. Fisher, III

[57] ABSTRACT

A resilient paint can accessory configured to be removably mounted on a paint can comprising a hollow frustrum stir skirt having an interrupted lower annular attachment element or ring formed on the lower periphery thereof to engage the inner lip of the paint can and to form a seal therewith such that when the resilient paint can accessory is mounted on the paint can the hollow frustrum stir skirt forms a stir area, a pour spout extends outwardly from the forward portion of the upper periphery of the hollow frustrum stir skirt to form a pour area and an upper annular liquid retainer element formed on a portion of the upper periphery of the hollow frustrum stir skirt and pour spout to contain paint within the stir area when stirring the paint within the paint can and to direct the paint from the paint through the pour area when pouring paint from the paint can.

19 Claims, 3 Drawing Sheets

RESILIENT PAINT CAN ACCESSORY

CROSS REFERENCE

This is a continuation-in-part application of co-pending application Ser. No. 052,268, filed May 21, 1987, now abandoned.

BACKGROUND OF THE INVENTION

1. Field of the Invention

A resilient paint can accessory configured to be removably mounted on a paint can including a stir skirt and pour spout.

2. Description of Prior Art

Paint cans are normally filled to the brim thereof. Thus stirring or dipping a brush causes an overglow of paint into the rim channel and down the side of the paint can. Paint in the rim channel often drys preventing effective resealing of the paint can. As a result paint within the paint can may dry during storage or spill if the paint can is knocked over. On the other hand, wet paint within the rim channel may act as an adhesive to seal the lid to the paint can. In addition, the circular shape of paint cans and rim channels precludes controlled pouring of the paint from such paint cans.

U S. Pat. No. 3,221,955 shows an attachment configured to be mounted on the annular brim of a paint can comprising a continuous annular rim portion having a dished top surface, a pair of spaced annular ridges depending from the underside of the rim portion being adapted to grip the inner edge of the brim of the paint can to prevent paint from accumulating in the gutter of the brim, an annular skirt depending from the rim portion and an annular flange depending from the underside of the rim portion spaced inwardly from the depending annular skirt to define a groove adapted to receive the outer edge of the brim of the paint can. The structure ridge is adapted to tightly engage the edge to prevent paint from entering and accumulating in the gutter portion of the paint can brim.

U.S. Pat. No. 4,203,537 disclosed a removable paint can accessory including an annular ring to cover the rim channel of a conventional paint can having pouring spout extending radially therefrom. The pouring spout includes a substantially planar surface capable of supporting a paintbrush. A leveraging means depending from the pouring spout permits force to be applied along the annular ring to remove the removable paint can accessory from the paint can.

U.S. Pat. No. 4,369,890 shows a paint can collar comprising a circular body having a lower lip portion to engage the rim of a paint can, an intermediate portion resting upon the top of the paint can and an upper lip portion projecting outwardly and upwardlt from the intermediate portion such that spilled paint will return into the paint can. The lower lip portion further includes a plurality of tabs to maintian the paint can collar in engagement with the inner rim of the paint can. The upper lip portion may also include a pair of bisymmetrical indentations so that the handle of the paint can may be moved into a functional position for carrying the paint can without removing the paint can collar.

U.S. Pat. No. 3,853,249 discloses a reusable pouring spout for paint cans and similar receptacles including a channel structure of resilient material opening radially outward that can be sprung into snug engagement with the rim of the paint can and a curved lip element extending outwardly from the channel structure. The resuable pouring sput can be removed from the paint can by contracting the channel structure.

The following U.S. Patents are additional examples of the prior art showing additional liquid pour spouts: U.S. Pat. Nos. 2,720,246; 2,765,966; 2,767,891; 2,960,257; 3,102,557; 3,272,395; 3,272,407; 3,309,000; 3,330,449; 3,356,266; 3,400,867; 4,203,537; 4,225,064; 4,240,568; 4,299,340 and 4,322,014.

SUMMARY OF THE INVENTION

The present invention relates to a resilient paint can accessory comprising a stir skirt and pour spout configured to be removably mounted on a paint can.

The stir skirt comprises a hollow frustrum stir skirt having an interrupted lower attachment element or ring formed on the lower periphery thereof to engage the inner lip of the paint can such that the hollow frustrum stir skirt forms a seal therewith. The pour spout comprises a concave pour spout extending outwardly from the forward portion of the upper periphery of the hollow frustrum stir skirt. The hollow frustrum stir skirt is disposed at an inclination with the horizontal plane such that the hollow frustrum stir skirt extends over the paint can rim or channel.

An upper liquid retainer element may be formed about a portion of the upper periphery of the hollow frustrum stir skirt and a portion of the outer periphery of the pour spout.

In use, the resilient paint can accessory is mounted on the paint can by the press fitting the interrupted lower attachment element or ring beneath the inner lip of the paint can and rotated such that the center line of the pour spout is substantially perpendicular to a line extending between handle mounts formed on the paint can such that the intersection of the upper periphery of the hollow frustrum stir skirt and origin of the pour spout is disposed forward of the handle mounts to permit selective use of the handle.

In this configuration the user may stir the paint within the extended stir area which in combination with the upper liquid retainer element prevents paint from entering into the paint can rim or channel and flowing down the side of the paint can. When prepared to pour, the user using the handle tips the paint can permitting the paint to be poured through the pour area.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
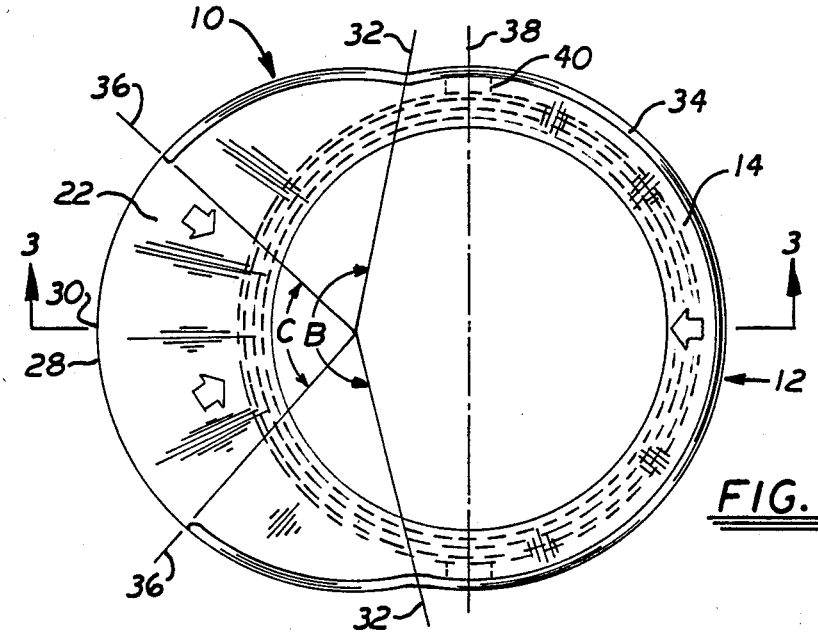
FIG. 1 is a top view of a resilient paint can accessory.
Figure 2:
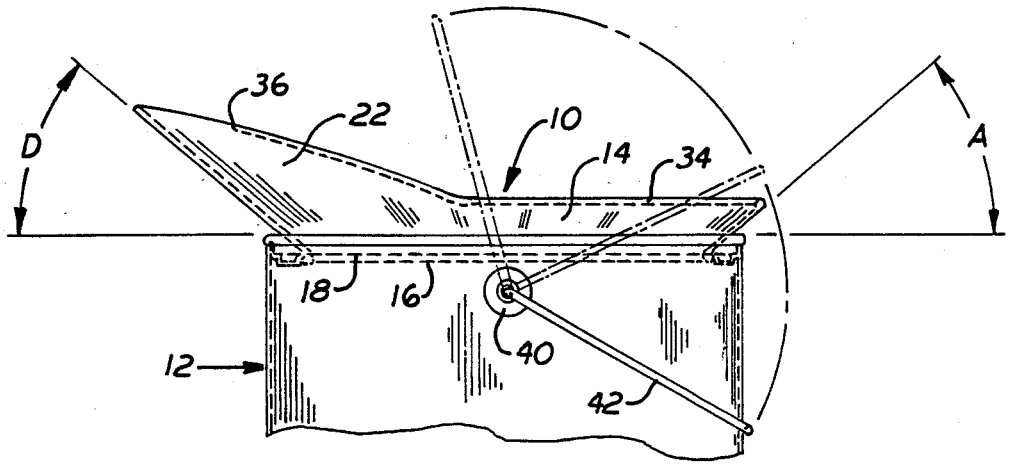
FIG. 2 is a side view of the resilient paint can accessory of FIG. 1.
Figure 3:
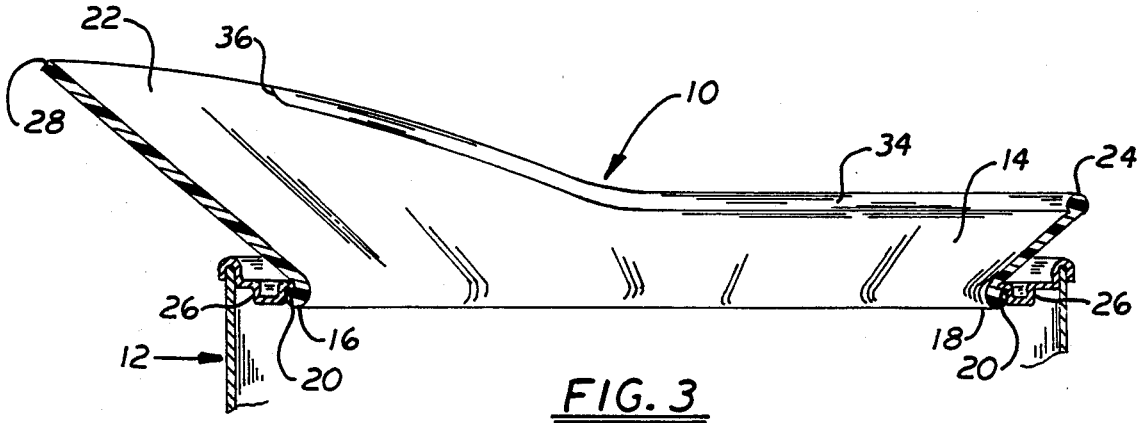
FIG. 3 is a cross-sectional side view of the resilient paint can accessory taken along line 3—3 of FIG. 1.
Figure 4:
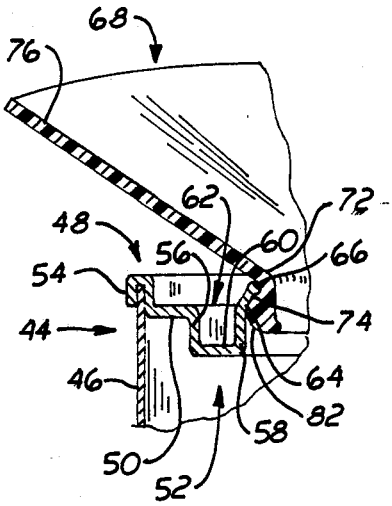
FIG. 4 is a detailed partial cross-sectional side view of the preferred embodiment of the front portion of the resilient paint can accessory.
Figure 5:
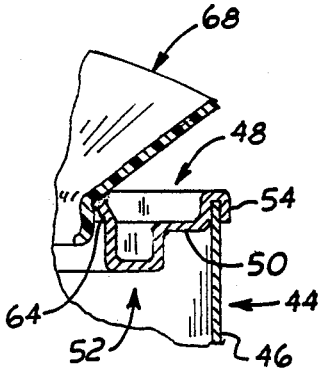
FIG. 5 is a detailed partial cross-sectional side view of the preferred embodiment of the rear portion of the resilient paint can accessory.

As shown in FIGS. 1 through 3, the present invention comprises a resilient paint can accessory generally indicated as 10 configured to be removably mounted on a paint can generally indicated as 12. The resilient paint can accessory 10 comprises a hollow frustrum stir skirt 14 having a resilient lower annular attachment element 16 formed on the lower periphery 18 thereof to engage the inner lip 20 of the paint can 12 to form a seal between the lower periphery 18 and inner lip 20 and a concave pour spout 22 extending outwardly from the forward portion of the upper periphery 24 of the hollow frustrum stir skirt 14.

As best shown in FIG. 1, the diameters of the lower and upper periphery 18 and 24 respectively of the hollow frustrum stir skirt 14 are substantially 5 inches and 6 inches respectfully; while the width of the hollow frustrum stir skirt 14 may be between ½ inch and 1 inch but preferably 6/8 inch forming an angle A of between 40 and 45 degrees but preferably 43 degrees with the horizontal plane such that the hollow frustrum stir skirt 14 extends over the paint can rim or channel 26. The resilient lower annular attachment element 16 of circular cross-section is substantially ⅛ inch in diameter.

The concave pour spout 22 comprises a thin walled member of 25 thousandths of an inch thickness at periphery 28 having an arc B of substantially 198 degrees extending outwardly from the hollow frustrum stir skirt 14 such that the center or widest point 30 extends substantially 2 inches outwardly from upper periphery 24 of the hollow frustrum stir skirt 14 and decreases in width to intersect the upper periphery 24 of the hollow frustrum stir skirt 14 at the intersection point 32 on opposite sides of the concave pour spout 22. The diameter of the upper periphery 24 is substantially equal to the diameter of the concave pour spout 22.

As shown in FIGS. 1 through 3, an upper liquid retainer element 34 is formed about the rear portion of the upper periphery 24 of the hollow frustrum stir skirt 14 and a portion of the constant radius outer periphery 28 of the concave pour spout 22 to direct the flow from the concave pour spout 22 through an arc C of substantially 92 degrees. The concave pour spout 22 forms an angle D of between 40 and 45 degrees but preferably 43 degrees in the horizontal plane. The major portion upper annular liquid retainer element 34 is substantially ⅛ inch in cross-sectional diameter and decreases in thickness one inch from the terminus points 36 on opposite sides of the concave pouring spout 22.

In use, the resilient paint can accessory 10 is mounted on the paint can 12 by press fitting the resilient lower annular attachment element 16 beneath the inner lip 20 and rotating the resilient paint can accessory 10 such that the center or widest point 30 of the concave pour spout 22 is substantially perpendicular to a line 38 extending between the handle mounts each indicated as 40 of the paint can 12 such that the intersection points 32 on the upper periphery 18 of the hollow frustrum stir skirt 14 are disposed forward of the line 38 between the handle mounts 40 to permit selective use of a handle 42.

In this configuration, the user may stir the paint within the extended stir area which in combination with the upper annular liquid retainer element 34 prevents paint from entering the paint can rim channel 26 or flowing down the side of the paint can 12. When prepared to pour, the user merely grasps the handles 42 as shown in FIG. 2 and tips the paint can 12 directing the paint through the pour area defined by the upper annular liquid retainer element 34.

FIGS. 4 through 7 show the preferred embodiment of the instant invention for use with a paint can generally indicated as 44 including the substantially cylindrical side wall 46 and substantially circular or annular top member generally indicated as 48. The substantially circular or annular top member 48 includes what is commonly known in the trade as a folded or raised lip. Specifically, the substantially circular or annular top member 48 comprises a substantially horizontal shelf or spacer 50 interconnecting a lid receiving groove generally indicated as 52 by a crimping or attachment element 54 affixed to the upper periphery of the substantially cylindrical side wall 46. The lid receiving groove 52 comprises a substantially vertical circular outer and inner groove element 56 and 58 respectively formed in substantially concentric relationship relative to each other by a lower interconnecting element 60 cooperatively forming a trough 62 therebetween and an inclined sealing/seating ring 64 extending inwardly from the inner groove element 58 toward the center of the paint can 44. The circumference 66 of the inclined sealing/seating ring 64 defines a paint can opening.

The resilient paint can accessory generally indicated as 68 is specifically configured to be removably coupled to the inclined sealing/seating ring 64. The resilient paint can accessory 68 comprises a hollow frustrum stir skirt 70 having an interrupted lower attachment element or ring 71 formed on the lower periphery 72 thereof to selectively engage the inner surface 74 of the inclined sealing/seating ring 64 such that the circumference 66 of the inclined sealing/seating ring 64 forms a seal with the hollow frustrum stir skirt 70 while retained in the paint can opening by the interrupted lower annular attachment element or ring. The resilient paint can accessory 68 further includes a pour spout 76 extending outwardly from the forward portion of the upper periphery of the hollow frustrum stir skirt 70.

Figure 6:
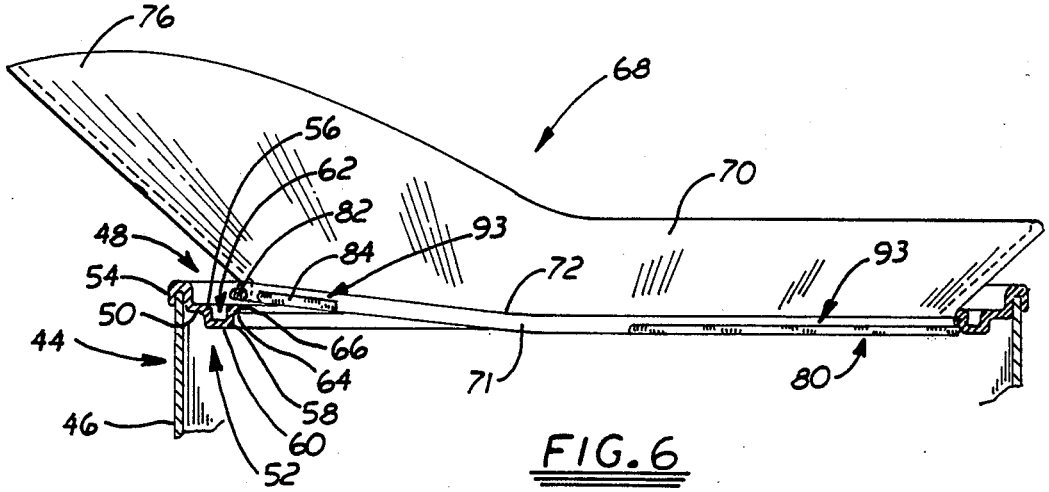
FIG. 6 is a side view of the preferred embodiment of FIGS. 4 and 5 of the resilient paint can accessory partially attached to a paint can.
Figure 7:
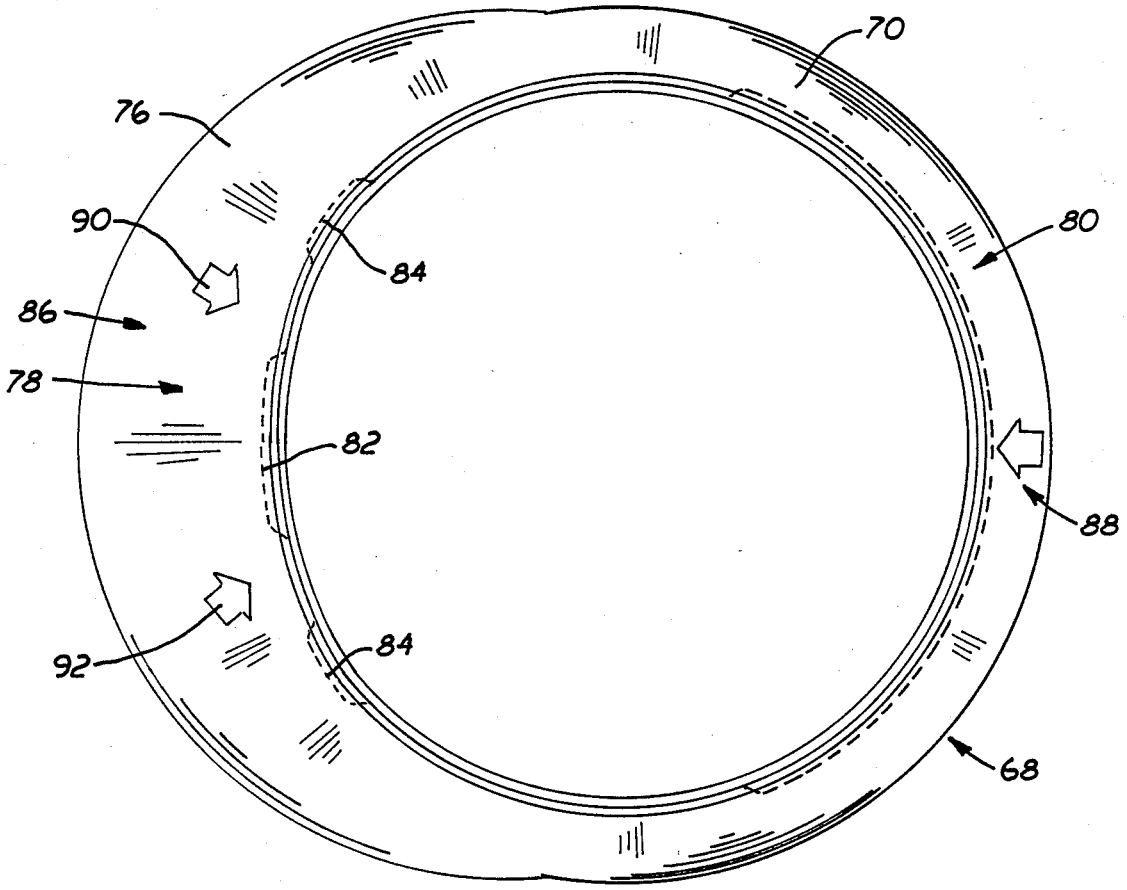
FIG. 7 is a top view of the preferred embodiment of FIGS. 4 and 5 of the resilient paint can accessory attached to a paint can.

As best shown in FIGS. 6 and 7, the resilient interrupted lower attachment element or ring 71 comprises a a front and rear attachment element or ring portion generally indicated as 78 and 80 respectively. The front attachment element or ring portion 78 comprises a primary front attachment element 82 and a pair of secondary front attachment elements each indicated as 84 formed in spaced relationship relative thereto. The primary front attachment element 78 is substantially 1 and ½ inches in length; while each secondary front attachment element 84 is substantially ¾ of an inch in length. The spacing or separation between the primary front attachment element 82 and each secondary front attachment element 84 is substantially ¾ of an inch. The rear attachment element or ring portion 80 is substantially six inches in length.

As best shown in FIG. 7, a front and rear indicia generally indicated as 86 and 88 respectively are formed on the upper surface of the resilient paint can accessory 68 as an aid in mounting the resilient paint can accessory 68 on the paint can 44. The front indicia 86 comprises a first and second front indicia element indicated as 90 and 92 respectively.

Since the interrupted lower attachment element ring 71 is discontinuous, the paint can accessory 68 of a single size is malleable and may be mounted on paint cans 44 of varying openings.

In use, the paint can accessory 68 is bent or folded and mounted on the paint can 44 by press fitting the resilient interrupted lower annular attachment element or ring beneath the inclined sealing/seating ring 64 and positioned as described regarding FIGS. 1 through 3. The rear indicia 88 is pressed down. The first and second front indicia elements 90 and 92 are then pressed down.

The resilient interrupted lower annular attachment element or ring allows the paint can accessory 68 to be flexed or bent to permit mounting and removal of the paint can accessory 68 to the paint can 44.

It should be noted as best shown in FIG. 6, the front and rear attachment elements or ring portions 78 and 80 are spaced apart substantially $\frac{1}{8}$th of an inch in width as at seat 93 from the lower periphery 72 of the hollow frustrum stir skirt 70 to receive the sealing/seating ring 64 therein.

Figure 8:
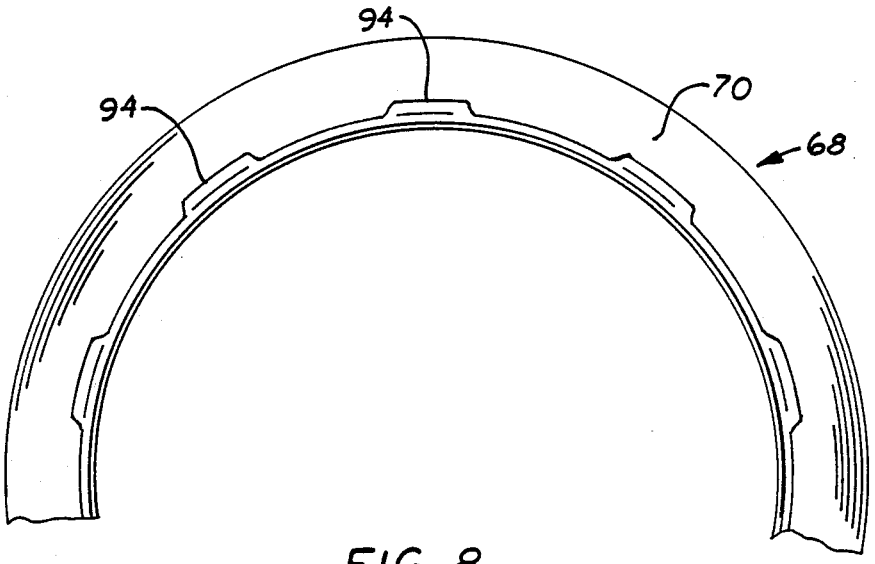
FIG. 8 is a partial bottom view of an alternate embodiment of FIGS. 4 and 5 of the resilient paint can accessory.

FIG. 8 shows an alternate embodiment of the resilient paint can accessory 68 wherein the resilient interrupted lower annular attachment element or ring comprises a plurality of symmertrically disposed attachment elements each indicated as 94.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A resilient paint can accessory configured to be removably mounted on paint cans of varying top dimensions including a trough having a sealing/seating ring including an inner circumference extending inwardly therefrom toward the center of the paint can, said resilient paint can accessory comprising a hollow frustrum stir skirt having a deformable ring extending downwardly from the lower periphery thereof cooperatively forming a seat therebetween to selectively receive the inner circumference of the sealing/seating ring therein, a front attachment portion including a primary front substantially round attachment element and a pair of secondary front substantially round attachment elements formed in spaced relationship thereto and a rear attachment portion including a rear substantially round attachment element formed on said deformable ring immediately adjacent said seat, said primary front substantially round attachment element being at least one and one half twice the length of each of said secondary front substantially round elements and said rear substantially round attachment element being at least three times length of said primary front substantially round attachment element such that said front and rear attachment portions engage the lower portion of the sealing/seating ring whereby a seal is formed between the inner circumference of the sealing/seating ring and said seat when said resilient paint can accessory is mounted on the paint can, said resilient paint can accessory further includes a stir area formed by said hollow frustrum stir skirt and a pour spout extending outwardly from the forward portion of the upper periphery of said hollow frustrum stir skirt to form a pour area to contain paint within said stir area when stirring the paint within the paint can and to direct the paint from the paint through said pour area when pouring paint from the paint can.

2. The resilient paint can accessory of claim 1 wherein the separation between adjacent front substantially round attachment elements is substantially equal to the length of said secondary front attachment elements.

3. The resilient paint can accessory of claim 1 wherein said primary front substantially round attachment element is substantially 1 and $\frac{1}{2}$ inches in length and each said secondary front substantially round attachment element is substantially $\frac{3}{4}$ of an inch in length.

4. The resilient paint can accessory of claim 3 wherein the separation between said primary front substantially round attachment element and each said secondary front substantially round attachment element is substantially $\frac{3}{4}$ of an inch.

5. The resilient paint can accessory of claim 4 wherein said rear substantially round attachment element is substantially 6 inches in length.

6. The resilient paint can accessory of claim 1 wherein the cumulative length of said attachment portions is less than one half the circumference of the lower periphery of said hollow frustrum stir skirt.

7. The resilient paint can accessory of claim 1 wherein said resilient interrupted lower attachment element comprises a plurality of symmetrically disposed attachment portions.

8. The resilient paint can accessory of claim 5 further including an indicia formed on the upper surface of said hollow frustrum stir skirt to provide a visual indication of where said resilient paint can accessory is to be press fitted into the paint can.

9. The resilient paint can accessory of claim 8 wherein said indicia comprises a front and rear indicia formed on the front and rear portions of said hollow frustrum stir skirt respectively.

10. The resilient paint can accessory of claim 9 wherein said front indicia comprises a first and second front indicia elements.

11. The resilient paint can accessory of claim 1 wherein said hollow frustrum stir skirt is substantially 6/8 inches in width.

12. The resilient paint can accessory of claim 9 wherein said hollow frustrum stir skirt disposed at a substantially 43 degree angle relative to the horizontal plane.

13. The resilient paint can accessory of claim 1 wherein said interrupted resilient lower attachment element comprises a lower annular attachment element of circular cross-sectional having a diameter of substantially $\frac{1}{8}$ inches.

14. The resilient paint can accessory of claim 1 wherein said concave pour spout comprises a substantially constant radius outer periphery through an arc of substantially 198 degrees.

15. The resilient paint can accessory of claim 14 wherein said concave pour spout extends from a maximum width of substantially 2 inches to intersect said upper periphery of said hollow frustrum stir skirt.

16. The resilient paint can accessory of claim 14 further including an upper liquid retainer element formed on a portion of said upper periphery of said hollow frustrum stir skirt and a portion of said substantially constant radius outer periphery of said concave pour spout to contain paint within said stir area when stirring the paint within the paint can and to direct the paint from the paint can through said pour area when pouring paint from the paint can.

17. The resilient paint can accessory of claim 16 wherein said upper liquid retainer element comprises a substantially circular cross-section of decreasing diameter.

18. The resilient paint can accessory of claim 16 wherein said pour area formed by said upper liquid retainer element extends through substantially 92 degrees.

19. The resilient paint can accessory of claim 5 wherein said seat is substantially $\frac{1}{8}$ of an inch in width.

* * * * *